US009644584B2

(12) United States Patent
Ishii et al.

(10) Patent No.: US 9,644,584 B2
(45) Date of Patent: May 9, 2017

(54) FUEL SUPPLY STRUCTURE FOR VEHICLE

(71) Applicant: HONDA MOTOR CO., LTD., Tokyo (JP)

(72) Inventors: Tsubasa Ishii, Wako (JP); Shosuke Suzuki, Wako (JP); Tsutomu Muraoka, Wako (JP); Takatomo Enami, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 391 days.

(21) Appl. No.: 13/786,185

(22) Filed: Mar. 5, 2013

(65) Prior Publication Data

US 2013/0239928 A1 Sep. 19, 2013

(30) Foreign Application Priority Data

Mar. 19, 2012 (JP) ..... 2012-062423

(51) Int. Cl.
*F02M 37/22* (2006.01)
*F02M 37/00* (2006.01)

(52) U.S. Cl.
CPC ..... *F02M 37/22* (2013.01); *F02M 37/0017* (2013.01); *Y10T 137/7976* (2015.04)

(58) Field of Classification Search
CPC ..... F02M 37/22; F02M 2037/226; F02M 2037/228; F02M 37/0017; Y10T 137/7976
See application file for complete search history.

(56) References Cited

U.S. PATENT DOCUMENTS 4,290,440 A * 9/1981 Sturgis ..... F16K 17/383 137/75
4,327,770 A * 5/1982 Brown ..... F16L 37/252 137/614.03
4,938,421 A * 7/1990 Berfield et al. ..... 239/309
6,206,432 B1 * 3/2001 Kamiyama ..... F16L 37/23 285/315
2004/0069704 A1 * 4/2004 Yamaguchi et al. ..... 210/497.01
2006/0170211 A1 * 8/2006 Matsubara ..... F16L 37/144 285/308
2009/0217911 A1 * 9/2009 Yokura et al. ..... 123/457

FOREIGN PATENT DOCUMENTS

JP 2011-157849 A 8/2011

* cited by examiner

*Primary Examiner* — Jacob Amick
(74) *Attorney, Agent, or Firm* — Birch, Stewart, Kolasch & Birch, LLP

(57) ABSTRACT

A vehicle fuel supply structure with an improved fuel filter for easy maintenance of the fuel filter. A vehicle fuel supply structure includes fuel in a fuel tank that is sucked by a fuel pump and supplied to a fuel injection valve disposed in a throttle body via a secondary fuel filter adapted to filter the fuel to remove foreign matter therein. A regulator is provided for regulating fuel pressure. The secondary fuel filter, the regulator and the fuel injection valve are connected by fuel pipes. A third fuel filter is installed at least in an inlet side connecting portion between the regulator and a regulator inlet side fuel pipe, of the fuel pipes, on the side where fuel enters the regulator.

10 Claims, 7 Drawing Sheets

FUEL SUPPLY STRUCTURE FOR VEHICLE

CROSS-REFERENCE TO RELATED APPLICATIONS

The present application claims priority under 35 USC 119 to Japanese Patent Application No. 2012-062423 filed Mar. 19, 2012 the entire contents of which are hereby incorporated by reference.

BACKGROUND OF THE INVENTION

1. Field of the Invention

The present invention relates generally to a fuel supply structure for a vehicle and more particularly to a fuel supply structure for an internal combustion engine.

2. Description of Background Art

Some conventional fuel supply structures for vehicles are configured such that, for example, when the fuel in a fuel tank is supplied to an engine, a fuel pump is used to pressurize the fuel to supply it to a fuel injection valve. In a fuel supply structure for a saddle-ride type vehicle disclosed in e.g. Japanese Patent Laid-Open No. 2011-157849, a fuel pump, a fuel filter, a regulator and a fuel injection valve are arbitrarily connected by fuel pipes.

In the saddle-ride type vehicle disclosed in Japanese Patent Laid-Open No. 2011-157849, for example, when a fuel filter is maintained, the fuel filter and a fuel pipe may be removed in some cases. If such a fuel pipe is operatively removed for maintenance, foreign matter may mix into a fuel pipe located on the downstream side of the fuel filter. In such a case, there is a problem wherein foreign matter may enter a fuel injection valve or an engine body without being removed.

If fuel containing ethanol is being used, it is desired to improve the function of the fuel filter more than ever and to provide a structure that can facilitate the maintenance of the fuel filter.

SUMMARY AND OBJECTS OF THE INVENTION

The present invention has been made in view of such circumferences and aims to provide a fuel supply structure for a vehicle that can improve the filtering structure of a fuel filter more than ever and also to facilitate the maintenance of a fuel filter.

To achieve the above object, an embodiment of the present invention includes a vehicle fuel supply structure wherein fuel in a fuel tank is supplied under pressure by a fuel pump to a fuel injection valve via a secondary fuel filter adapted to filter the fuel to remove foreign matter therein with a regulator adapted to regulate fuel pressure. The secondary fuel filter, the regulator and the fuel injection valve are connected by fuel pipes. A third fuel filter is installed at least in an inlet side connecting portion between the regulator and a regulator inlet side fuel pipe of the fuel pipes with the regulator inlet side fuel pipe being adapted to deliver fuel to the regulator.

According to an embodiment of the present invention, the third fuel filter is positioned and held in the inlet side connecting portion by a fuel inlet inner circumferential wall of the regulator.

According to an embodiment of the present invention, a fourth fuel filter is installed in an outlet side connecting portion between the regulator and a regulator outlet side fuel pipe adapted to deliver fuel from the regulator to the fuel injection valve.

According to an embodiment of the present invention, the fourth fuel filter is positioned and held in the outlet side connecting portion by a fuel outlet inner circumferential wall of the regulator.

According to an embodiment of the present invention, the fuel pump is installed in the fuel tank. A tank bottom portion, provided with a fuel discharge port of the fuel pump, is formed with a tank hanging wall hanging downward of the vehicle. The regulator is mounted on the inside of the tank hanging wall with the secondary fuel filter being installed below the tank bottom portion.

According to an embodiment of the present invention, the regulator is disposed above the secondary fuel filter.

According to an embodiment of the present invention, the provision of the third fuel filter improves an effect-function of removing foreign matter mixing in fuel. Therefore, if an alcohol additive fuel is used, the provision of the third fuel filter provides an extremely useful structure therefor. Since the third fuel filter is installed in the connecting portion in front of the regulator, for example, if the connecting portion of the regulator inlet side fuel pipe is removed, foreign matter that has entered the regulator inlet side fuel pipe can be prevented from entering the regulator. Further, foreign matter can effectively be prevented from entering the fuel injection valve.

The third fuel filter is installed in the inlet side connecting portion between the regulator inlet side fuel pipe and the regulator. Therefore, the third fuel filter can easily be attached or detached only by removing the regulator inlet side fuel pipe, which provides satisfactory maintenance.

According to an embodiment of the present invention, the third fuel filter is positioned and held in the inlet side connecting portion of the regulator by the fuel inlet inner circumferential wall. Therefore, when the fuel pipe of the connecting portion is removed, the third fuel filter is held without coming off. When the fuel pipe is removed, the third fuel filter can be removed only by being pulled out. Thus, the removal is easy, so that maintenance performance is satisfactory.

According to an embodiment of the present invention, the provision of the third and fourth fuel filters can more enhance the effect of removing foreign matter mixing in fuel. Further, an effect of filtering fuel full of an alcohol additive components is improved. In addition, the third and fourth fuel filters are installed in both the inlet side and outlet side connecting portions of the regulator; therefore, also maintenance performance is satisfactory.

According to an embodiment of the present invention, the fourth fuel filter is positioned and held in the outlet side connecting portion of the regulator by the fuel outlet inner circumferential wall. Therefore, when the fuel pipe of the outlet side connecting portion is removed, the fourth fuel filter is held without coming off and can easily be removed. Thus, maintenance performance is satisfactory.

According to an embodiment of the present invention, the regulator is installed on the inside of the hanging portion of the fuel tank. Therefore, the protecting member for the regulator can be eliminated. In addition, the regulator is installed close to the fuel tank. Therefore, the fuel pipe can be shortened. Since the regulator is directly attached to the fuel tank, the space below the fuel tank can be enlarged. That is to say, the surrounding of the secondary fuel filter disposed below the fuel tank can be broadened. Thus, a working space can easily be ensured for maintenance or the like.

According to an embodiment of the present invention, the regulator is disposed above the secondary fuel filter. Therefore, the regulator inlet side fuel pipe connecting the secondary fuel filter with the regulator can be arranged to extend along the vertical direction. Thus, during the maintenance or replacement of the secondary fuel filter, bubbles or the like mixing in the fuel supply route can rapidly be led through its ascending force to the third fuel filter in the regulator disposed on the upside.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
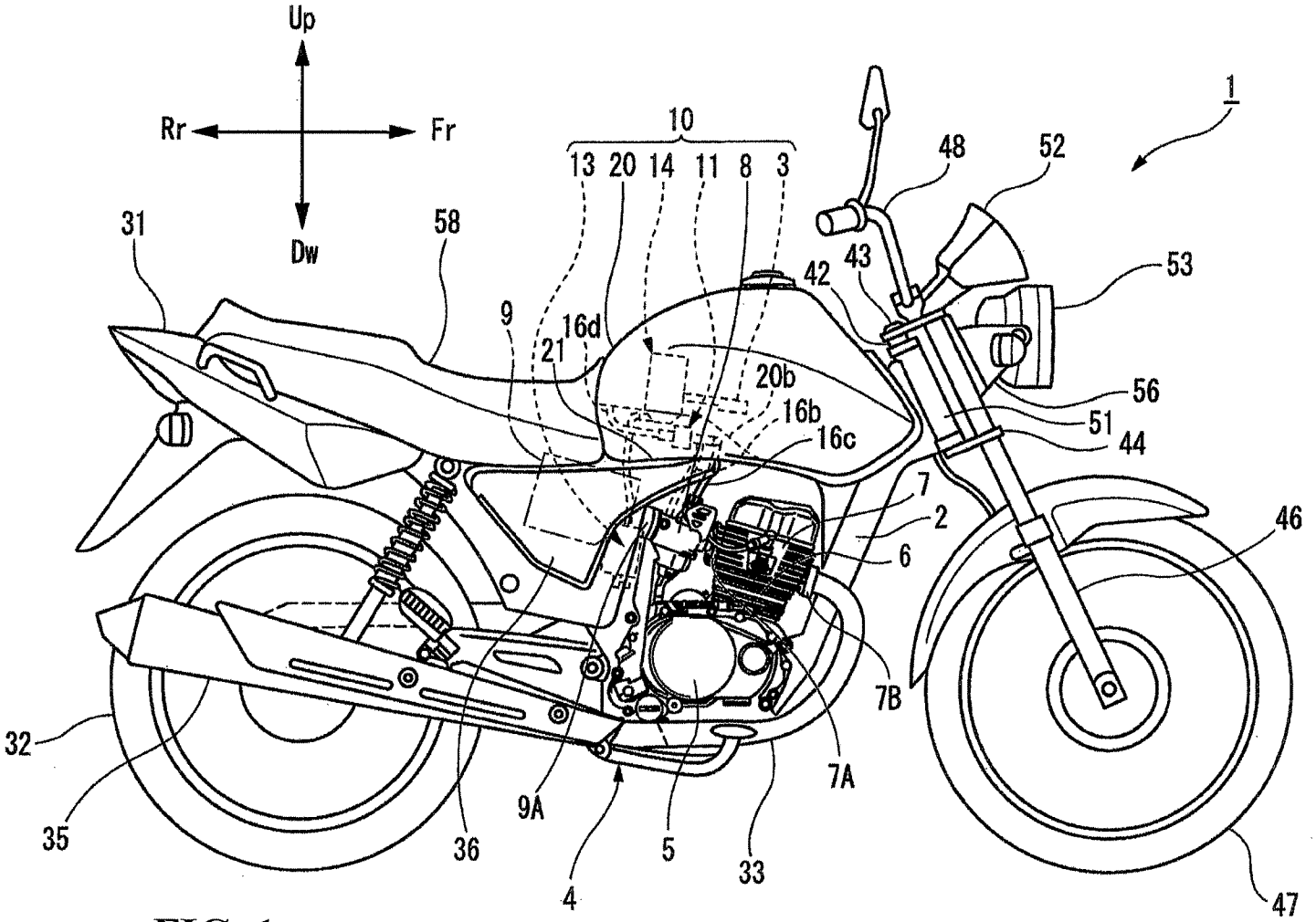
FIG. 1 is a right lateral view of a motorcycle according to a first embodiment of the present invention.

A description will hereinafter be given of embodiments of the present invention.

A motorcycle as an example of a saddle-ride type vehicles in an embodiment is described with reference to FIGS. 1 to 6. In the embodiments described below, the descriptions of directions such as front and back or rear, left and right, and upside and downside in the specification are with respect to the vehicle body of the motorcycle. The accompanying drawings shall be viewed based on the direction of the reference numerals described in the figures. As regards the descriptions of the directions in the figures, symbol Fr denotes the front of the vehicle body, Rr denotes the rear of the vehicle body, Up denotes the upside of the vehicle body, Dw denotes the downside of the vehicle body, R denotes the right of the vehicle body and L denotes the left of the vehicle body.

FIG. 1 is a right lateral view of a motorcycle 1 of the present embodiment. As shown in FIG. 1, the motorcycle 1 has a handlebar shaft 42 turnably inserted into a head pipe 51, a top bridge 43 at the top end of the handlebar shaft 42 and a bottom bridge 44 at the lower end of the handlebar shaft 42. A front fork 46 is attached to the respective front portions of the top bridge 43 and the bottom bridge 44. A front wheel 47 is attached to the lower end of the front fork 46. A handlebar 48 is attached to the top bridge 43. A meter 52 and a headlamp 53 are attached to the top bridge 43 via a bracket 56. A body frame 2 extends rearwardly from the head pipe 51. An engine 4 is mounted on the body frame 2. A fuel tank 20 is disposed above the engine 4. A seat 58 is disposed behind the fuel tank 20. A side cover 36 covers below the seat 58 and the fuel tank 20. Further, a rear cowl 31 covers below the rear portion of the seat 58. A swing arm (not shown) is installed in the rear portion of the body frame 2. A rear wheel 32 is attached to the swing arm. An exhaust pipe 33 extends rearward from the engine 4. A muffler 35 is joined to the rear end of the exhaust pipe 33.

In the motorcycle 1 of the present embodiment, the engine 4 includes a crankcase 5, a cylinder block 6 extending generally upward from the front portion of the crankcase 5 and a cylinder head 7 joined to the upper portion of the cylinder block 6. The engine 4 is an air-cooled engine having cooling fins on the outer circumferential surfaces of the cylinder block 6 and the cylinder head 7. In addition, a piston is received in a cylinder of the cylinder block 6 in a reciprocative manner. A crankshaft connected via a connecting rod to the piston and an output shaft of the engine are rotatably supported by the crankcase 5. A clutch mechanism, a transmission mechanism and the like which constitute a power transmission mechanism between the crankshaft and the output shaft are received in the crankcase.

The cylinder head 7 houses intake and exhaust valves adapted to open and close intake and exhaust passages communicating with the cylinder in the cylinder block 6. The cylinder head 7 is formed on its rear surface with an intake port 7A of the intake and exhaust passages. A throttle body 8 is connected to the intake port 7A. An air cleaner box 9 is connected to the throttle body 8 via an intake passage 9A. On the other hand, the cylinder head 7 is formed on its front surface with an exhaust port of the intake and exhaust passages. The exhaust pipe 33 is joined to the exhaust port 7B. The exhaust pipe 33 extends forward from the exhaust port, e.g., extends forward of the cylinder head 7, bends downwardly, further extends rearwardly of the vehicle on the right of the vehicle, and is joined to the muffler 35 at its extending end. A fuel supply structure 10 adapted to supply fuel from the fuel tank 20 to the throttle body 8 is disposed below the rear portion of the fuel tank 20.

The fuel supply structure 10 of the present embodiment is hereinafter described in detail with reference to FIGS. 1 to 6.

Figure 2:
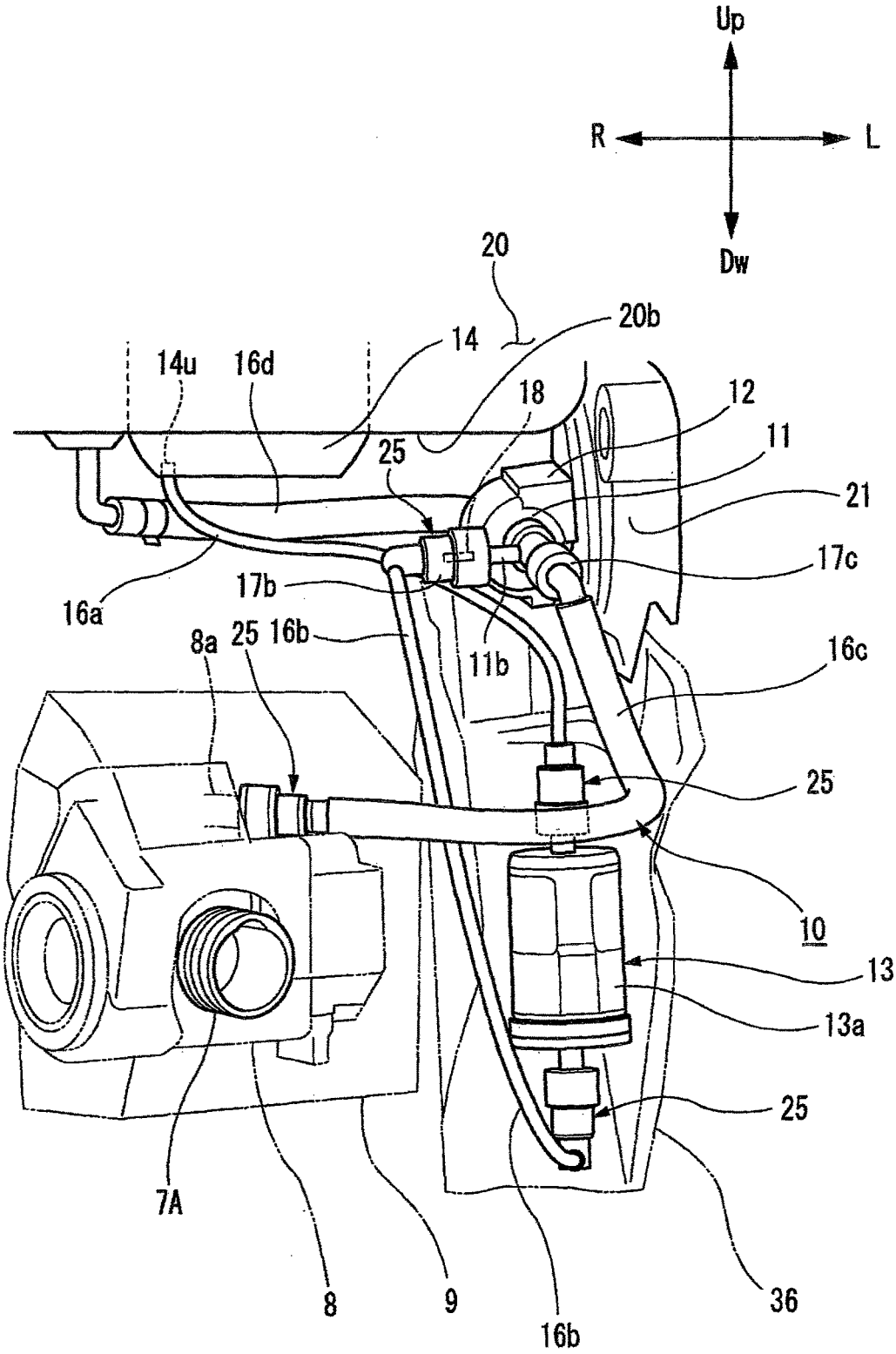
FIG. 2 is a schematic perspective view of an essential portion of a fuel supply structure of the motorcycle shown in FIG. 1, as viewed from the position near an intake port of an engine toward the rearward of the vehicle.
Figure 3:
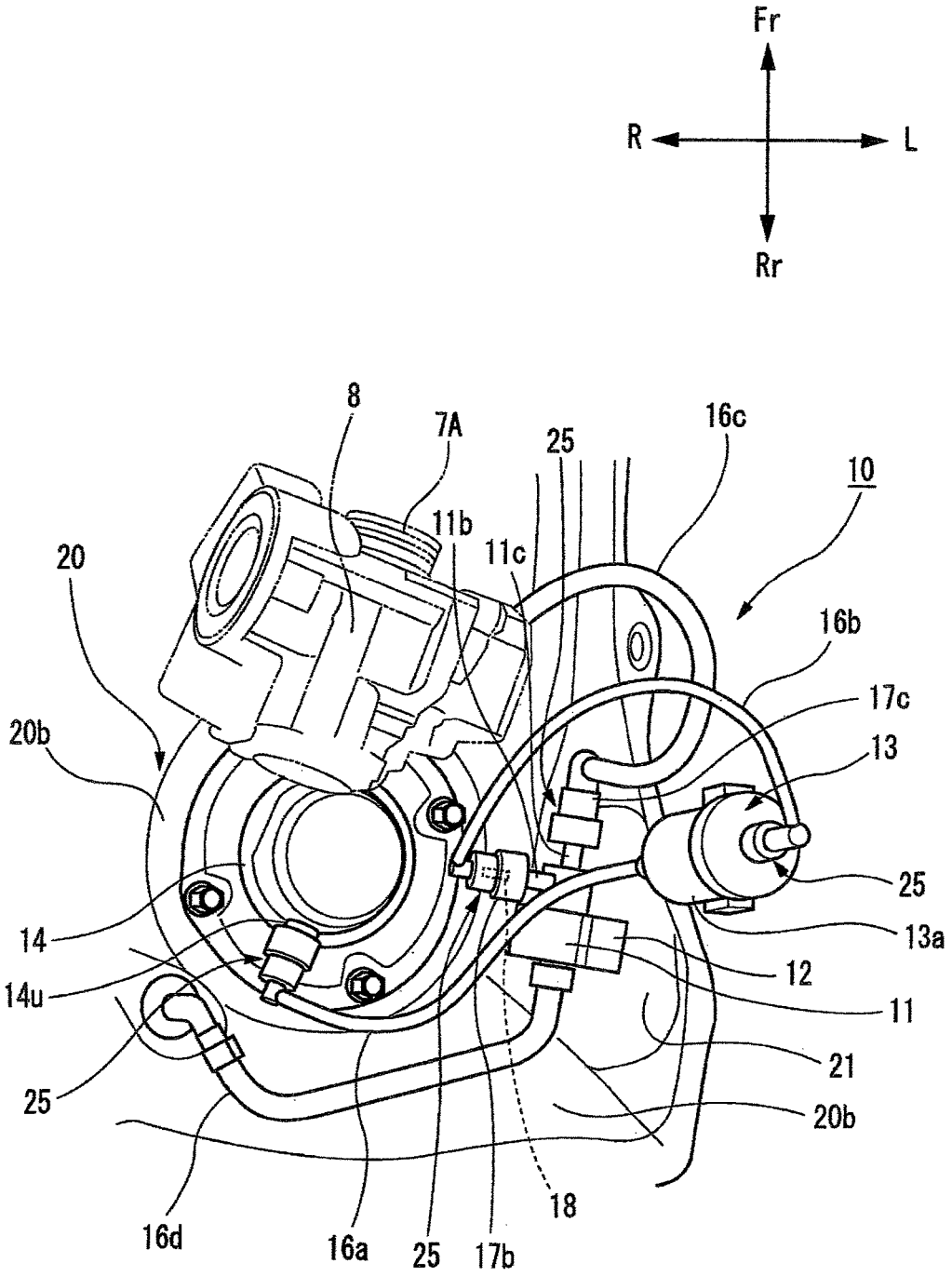
FIG. 3 is a schematic perspective view of the essential portion of the fuel supply structure of the motorcycle shown in FIG. 1, as viewed from the downside of the vehicle.

As shown in FIGS. 1, 2 and 3, a fuel pump 14 is installed inside the fuel tank 20. The fuel pump 14 is located at the rear side of the fuel tank 20 and is longitudinally arranged on a tank bottom portion 20*b* above the throttle body 8. In addition, the fuel pump is provided with a suction fuel filter 3 at a suction port portion thereof. The suction fuel filter 3 is used to prevent foreign matter in the fuel tank from being sucked in. A secondary fuel filter 13 serving as a secondary filter and a regulator 11 are located below the fuel tank 20 at a position close to the throttle body 8. The secondary fuel filter 13, the regulator 11 and the throttle body 8 are connected by fuel pipes 16 (which are individually indicated by reference numerals 16*a*, 16*b*, 16*c* and 16*d* in the figures).

As regards the positions where the members of the fuel supply structure 10 are mounted on the fuel tank 20, the regulator 11 is directly mounted on the lower side of the fuel tank 20. The secondary fuel filter 13 is disposed further below the regulator 11. The regulator 11 and the secondary fuel filter 13 are disposed on the left side of the vehicle.

In the present embodiment, the fuel pump 14 is installed inside the fuel tank 20. As shown in FIGS. 2 and 3, a fuel discharge port 14*u* of the fuel pump 14 is provided on the outside of the tank bottom portion 20*b*. Further, the tank bottom portion 20*b* is formed with tank hanging walls 21 hanging downward of the vehicle on both left and right sides (only one is shown in FIGS. 2 and 3). Space surrounded by the tank hanging walls 21 is formed on the lower side of the fuel discharge port 14*u* of the fuel pump 14. The regulator 11 is mounted on the rightward in FIGS. 2 and 3 (the leftward in the direction of the vehicle) inside of one of the tank hanging walls 21. The secondary fuel filter 13 is disposed further below the regulator 11.

The attachment structure of the regulator 11 is not particularly restrictive. For example, the regulator 11 is mounted on the inside of the tank hanging wall 21 so that it can easily be mounted and removed via a holding member 12 which holds a large-diameter portion of a regulator body 11*a*.

The secondary fuel filter 13 in the present embodiment is such that a replaceable filter member is incorporated in a cylindrically-shaped openable-closable filter case 13*a*. The secondary fuel filter 13 is longitudinally arranged on the inside of the side cover 36. A pump discharge fuel pipe 16*a* connected to the fuel discharge port 14*u* is connected to the upper portion of the filter case 13*a*. A regulator inlet side fuel pipe 16*b* is connected to the lower portion of the filter case 13*a*. In addition, quick connectors 25, that can allow for easy attachment and detachment, are used to connect the secondary fuel filter 13 with the pump discharge fuel pipe 16*a* and with the regulator inlet side fuel pipe 16*b*.

As described above, the regulator 11 is mounted on the inside of the tank hanging wall 21 of the fuel tank 20. Therefore, a protecting member for the regulator 11 is unnecessary. The regulator 11 is disposed close to the tank bottom portion 20*b* of the fuel tank 20. Therefore, a return side fuel pipe 16*d* from the regulator 11 can be shortened. The regulator 11 is directly mounted on the fuel tank 20. Not only the regulator 11 per se is located nearer the upside but also the fuel pipe connected to the regulator 11 can be arranged nearer the upside. The surrounding of the secondary fuel filter 13 disposed on the downside of the regulator 11 can be broadened. Thus, a working space for maintenance of the secondary fuel filter 13 can be ensured.

A description is given of a fuel route of the fuel supply structure 10 shown in FIGS. 2 and 3.

The fuel in the fuel tank 20 is first sucked by the fuel pump 14 disposed inside the fuel tank 20 via the suction fuel filter 3. The fuel thus sucked is discharged from the fuel discharge port 14*u*, which is installed at the lower end of the fuel pump 14 and on the outside of the tank-lower surface of the tank bottom portion 20*b* of the fuel tank 20. The pump discharge fuel pipe 16*a* is connected to the fuel discharge port 14*u*. The fuel is supplied from the upper portion of the filter case 13*a* via the pump discharge fuel pipe 16*a* to the secondary fuel filter 13. The fuel is filtered by the secondary fuel filter 13 to remove foreign matter or the like. The fuel thus filtered is supplied from the lower portion of the filter case 13*a* via the regulator inlet side fuel pipe 16*b* to an inlet side connection pipe portion 11*b* of the regulator 11.

The fuel to be supplied to the regulator 11 passes through a third fuel filter 18 (see FIG. 4) installed at an inlet side connecting portion 17*b* of the regulator 11 and is supplied to the regulator 11. The fuel having been supplied to the regulator 11 is supplied at a predetermined amount to a fuel injection valve 8*a* via a regulator outlet side fuel pipe 16*c* by returning surplus fuel to the fuel tank 20 via the return side fuel pipe 16*d* attached to a return side connecting portion 17*d* if fuel pressure is high.

Figure 4:
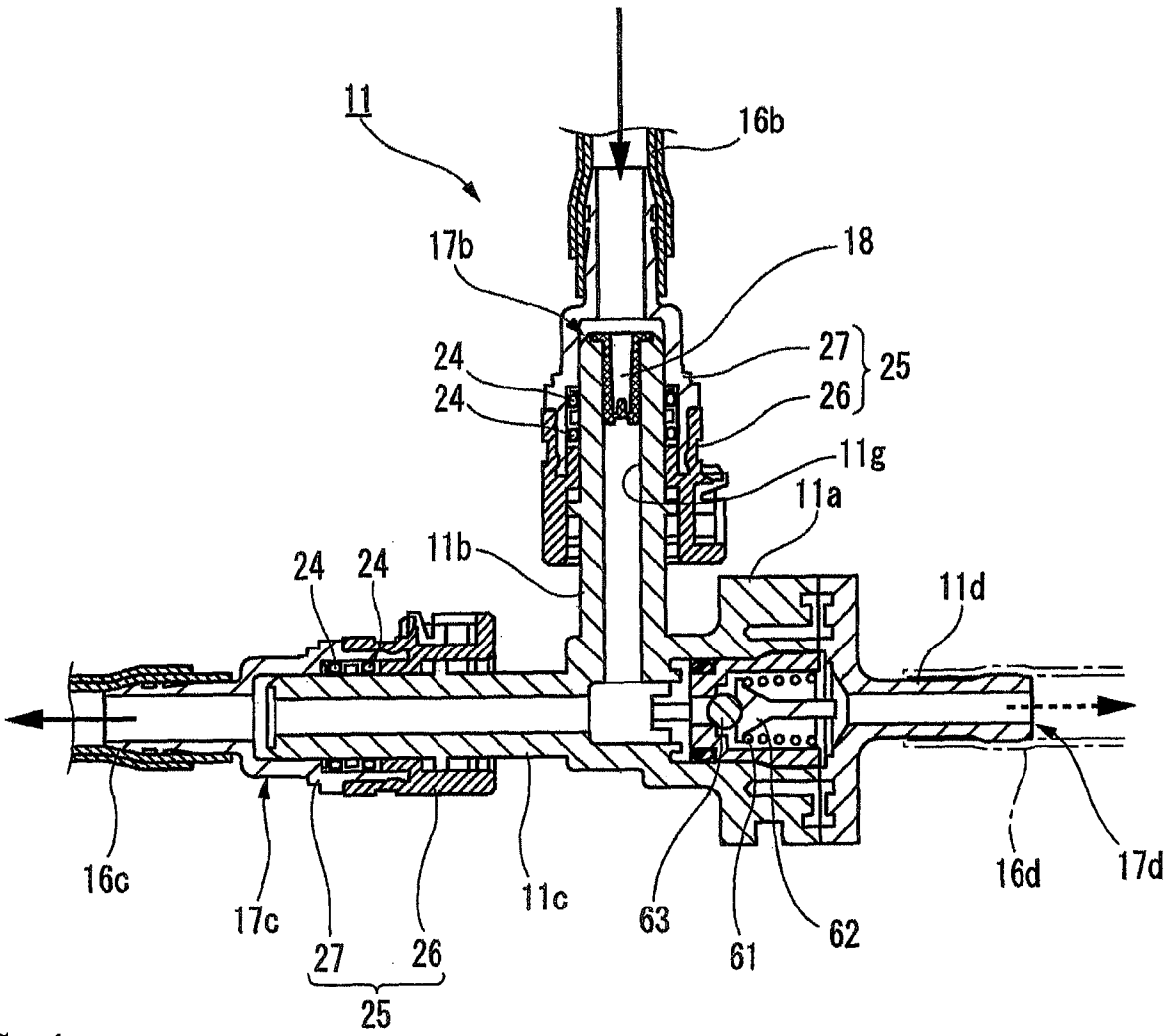
FIG. 4 is a schematic longitudinal cross-sectional view of a regulator according to the first embodiment of the present invention.

As shown in FIG. 4, the regulator 11 of the present embodiment is composed of the regulator body 11*a* having the inlet side connection pipe portion 11*b*, the outlet side connection pipe portion 11*c* and the return side connection pipe portion 11*d*. The quick connector 25 is installed to connect the regulator 11 with the regulator inlet side fuel pipe 16*b* and with the regulator outlet side fuel pipe 16*c* to facilitate the attachment and detachment of the fuel pipes. More specifically, a female connector portion 26 is attached to each of the inlet side connection pipe portion 11*b* and outlet side connection pipe portion 11*c* of the regulator 11. On the other side, a male connector portion 27 is attached to each of the regulator inlet side fuel pipe 16*b* and the regulator outlet side fuel pipe 16*c*. Thus, when both the fuel pipes are to be operatively connected, they can be connected only by pressing the male connector portions 27. When both the fuel pipes are to be detached, they can easily be operatively detached by releasing the engagement of e.g. a claw or the like. The quick connector 25 has a plurality of seal members 24 for ensuring the seal with the inlet side connection pipe portion 11*b* and with the outlet side connection pipe portion 11*c*.

As shown in FIG. 4, the regulator 11 of the present embodiment is such that the regulator inlet side fuel pipe 16*b* is coupled to the inlet side connection pipe portion 11*b*, the regulator outlet side fuel pipe 16*c* is coupled to the outlet side connection pipe portion 11*c* and the return side fuel pipe 16*d* is coupled to the return side connection pipe portion 11*d*. The return side connection pipe portion 11*d* has a spherical member 63 that opens and closes the passage with a holding member 62 that holds the spherical member 63 and a compressive spring 61 that biases the holding member 62 in a predetermined direction. Thus, when fuel pressure is higher than a predetermined level, the spherical member 63 is shifted against the pressure of the compressive spring 61 to open the return fuel passage to supply surplus fuel to the return side connection pipe portion 11*d*, thereby returning it to the fuel tank 20.

In the present embodiment, fuel passing through the suction fuel filter 3 and then discharged from the fuel tank 20 is filtered by the secondary fuel filter 13 to remove foreign matter therein. Before entering the regulator 11, fuel is filtered also by the third fuel filter 18 disposed in the inlet side connecting portion 17*b* between the regulator inlet side fuel pipe 16*b* and the regulator 11.

As described above, the third fuel filter 18 is installed in addition to the secondary fuel filter 13. Therefore, a filtering function is more improved. This configuration described above is an extremely useful filter structure particularly when fuel such as an alcohol additive fuel containing a relatively large amount of impurities is used.

The third fuel filter 18 is installed in the inlet side connecting portion 17*b* of the regulator 11. For example, when the regulator inlet side fuel pipe 16*b* is removed for maintenance, even if foreign matter enters the regulator inlet side fuel pipe 16*b*, it can be removed through the filtering of the third fuel filter 18. That is to say, foreign matter can be prevented from entering the inside of the regulator 11. Further, foreign matter can be prevented from entering the fuel injection valve 8*a*.

The third fuel filter 18 is positioned and held in a state of being fitted into a fuel inlet inner circumferential wall 11*g* of the regulator 11 at the inlet side connecting portion 17*b*. Since the third fuel filter 18 is attached in the fitted state, even if the regulator inlet side fuel pipe 16*b* is removed, then the third fuel filter 18 will not come off. The third fuel filter 18 can be attached or detached by the operation of the removal of the regulator inlet side fuel pipe 16*b*. Thus, operability during maintenance is extremely satisfactory.

In the present embodiment, as shown before, the regulator 11 is disposed above the secondary fuel filter 13. Therefore, the regulator inlet side fuel pipe 16*b* is disposed to form a vertical passage extending from the secondary fuel filter 13 toward the regulator 11 (see FIG. 2). Thus, for example, when the secondary fuel filter 13 is maintained or replaced, bubbles or the like mixing into the regulator inlet side fuel pipe 16*b* can rapidly be led through its ascending force to the third fuel filter 18 disposed on the upside.

A description is hereinafter given of the structure of the third fuel filter 18 according to the embodiment with reference to FIG. 5.

The third fuel filter 18 has a filter member 28*a* attached to a generally cylindrical frame member 28*b* so as to conform to the inner surface shape of the fuel inlet side inner circumferential wall 11*g* of the inlet side connection pipe portion 11*b*. The frame member 28*b* is configured such that a flange portion 28*f* formed in a general donut-shape and a circular frame portion 28*c* are connected by e.g. three longitudinal frame portions 28*e*. The filter member 28*a* is attached to the inside of the frame member 28*b* and the outside of the flange portion 28*f*.

Figure 6:
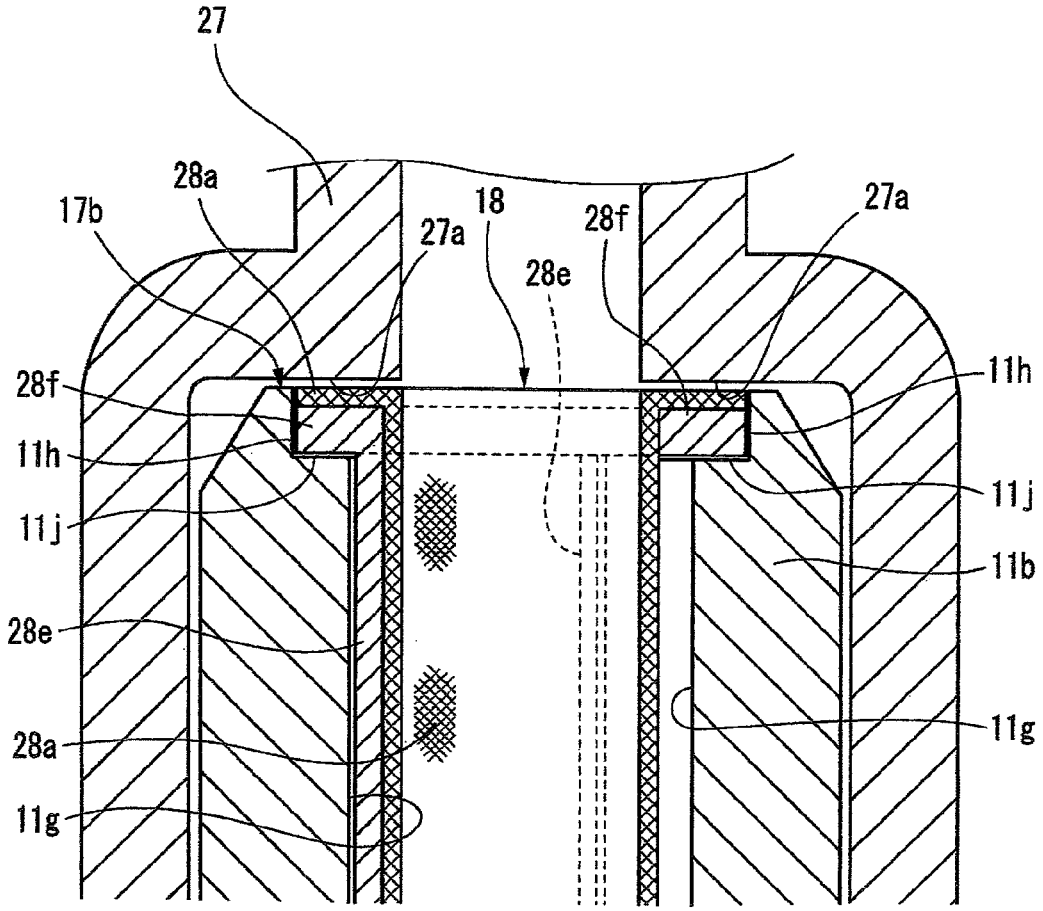
FIG. 6 is a partial cross-sectional view showing a holding structure for the third fuel filter according to the first embodiment of the present invention.

As shown in FIG. 6, the third fuel filter 18 configured as described above is held such that the flange portion 28*f* is fitted to the inside of a large-diameter portion 11*h* formed at the inlet side connection pipe portion 11*b*. More specifically, the third fuel filter 18 is held such that the flange portion 28*f* is fitted to the inner circumferential surface of the large-diameter portion 11*h* and a stepped portion 11*j* of the fuel inlet inner circumferential wall 11*g*. In addition, the longitudinal frame portion 28*e* is fitted to and held by the fuel inlet inner circumferential wall 11*g* so as to extend there along. In the state where the male connector portion 27 is connected, the flange portion 28*f* is positionally restricted by a stepped inner surface 27*a* of the male connector portion 27 facing the flange portion 28*f*. Thus, after the third fuel filter 18 is fitted and attached to the fuel inlet inner circumferential wall 11*g* of the inlet side connection pipe portion 11*b*, the attachment of the third fuel filter 18 is completed by connecting the male connector portion 27. In addition, when the third fuel filter 18 is to be removed, it can easily be removed from the fuel inlet inner circumferential wall 11*g* (the inlet side connecting portion 17*b*) of the inlet side connection pipe portion 11*b* only by removing the male connector portion 27.

In addition, the present embodiment provides the structure in which the third fuel filter 18 is positionally restricted by the stepped inner surface 27*a* of the male connector portion 27. However, another structure may be available in which, for example, an elastic member or the like is installed on or inside the stepped inner surface 27*a* of the male connector portion 27 so as to actively press and hold the flange portion 28*f* of the third fuel filter 18.

With this structure, the third fuel filter 18 is positioned and held in the inlet side connecting portion 17*b* of the regulator 11 by the fuel inlet inner circumferential wall 11*g*. Therefore, when the regulator inlet side fuel pipe 16*b* is removed, the third fuel filter 18 is held without easily coming off. In addition, the third fuel filter 18 can easily be removed only by pulling operation when the regulator inlet side fuel pipe 16*b* is removed.

The regulator inlet side fuel pipe 16*b* can easily be attached or detached by the attachment/detachment of the quick connector 25. In addition, not only the third fuel filter 18 can be attached or detached by the attachment/detachment operation of the quick connector 25 but it can be prevented from coming off even if the regulator inlet side fuel pipe 16 is removed. Thus, operability during maintenance is satisfactory.

A second embodiment of the present invention will hereinafter be described with reference to FIG. 7.

Figure 7:
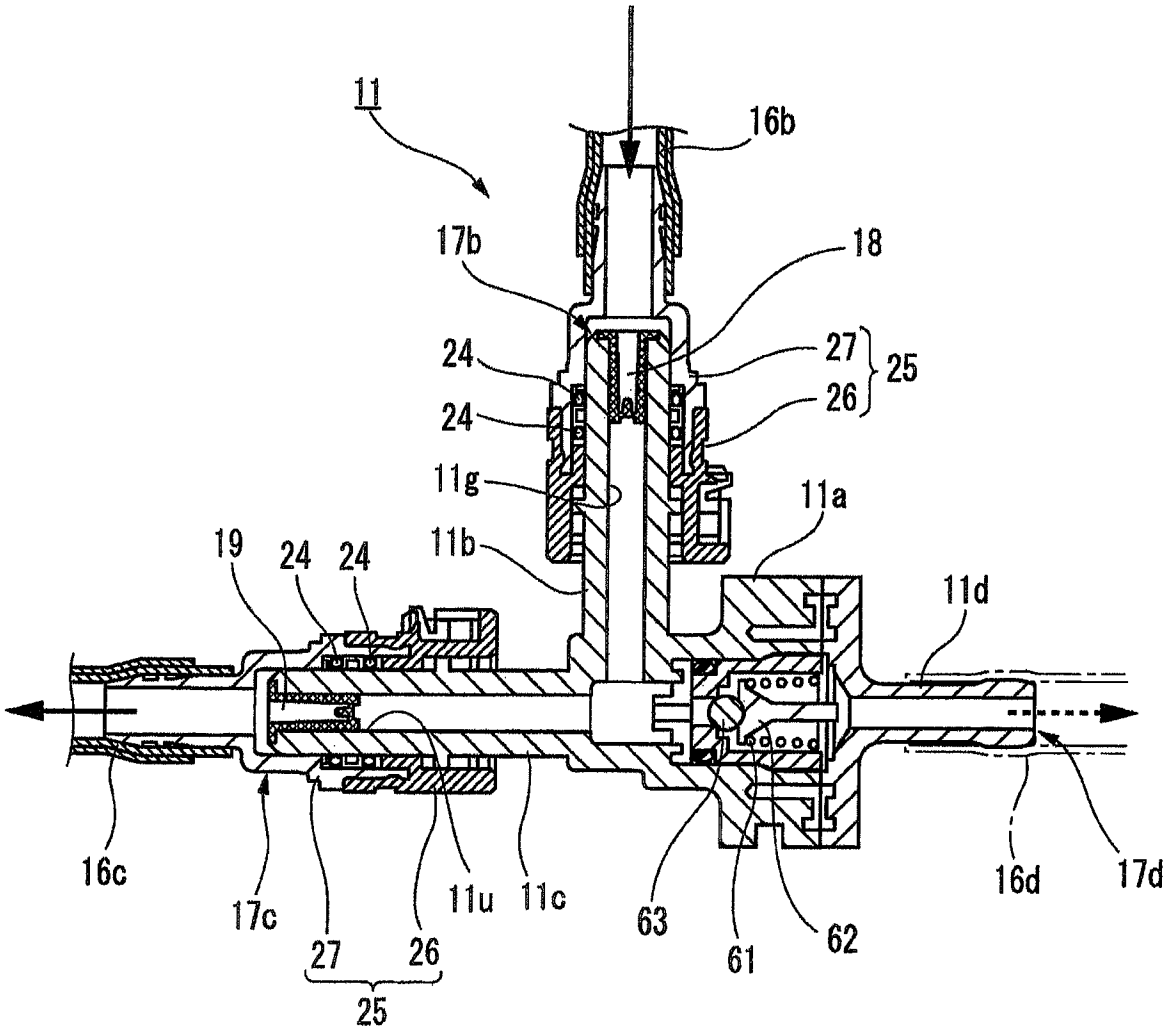
FIG. 7 is a schematic longitudinal cross-sectional view of a regulator according to a second embodiment of the present invention.

In addition, a configuration shown in FIG. 7 is the same as that of the first embodiment except the configuration of a fourth fuel filter 19. The same constituent elements as those in the first embodiment are denoted by like reference numerals and their explanations are omitted.

The fuel supply structure 10 of the present embodiment has a fourth fuel filter 19 installed in an outlet side connecting portion 17*c* on the side where fuel is delivered from the regulator 11 to the fuel injection valve 8*a*, in addition to the third fuel filter 18 that is the same as that in the first embodiment.

The fourth fuel filter 19 of the present embodiment has entirely the same holding structure as that described with FIG. 6 of the first embodiment although it is not particularly illustrated. That is to say, the fourth fuel filter 19 is positioned and held so as to be fitted to a fuel outlet inner circumferential wall 11*u* of the regulator 11 at the outlet side connecting portion 17*c*.

Figure 5:
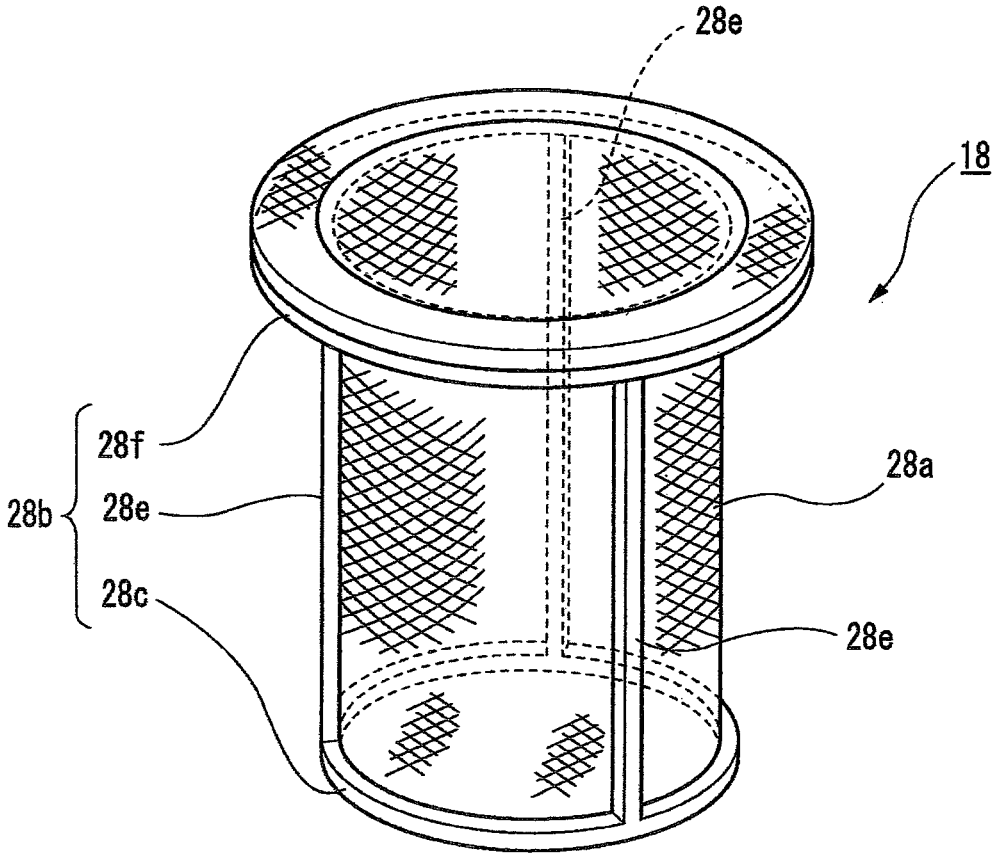
FIG. 5 is a perspective view of a third fuel filter according to the first embodiment of the present invention.

In addition, the fourth fuel filter 19 of the present embodiment may be configured such that the filter member 28*a* is attached to the generally cylindrical frame member 28*b* similarly to that of the first embodiment shown in FIG. 5. However, in view of the direction of the installation of the fourth fuel filter 19 and the flowing direction of fuel, the present embodiment is different from the first embodiment. Therefore, it is desirable that the filter member 28*a* should be installed on the outside of the frame member 28*b*.

In the present embodiment, the fourth fuel filter 19 is positioned and held in the outlet side connecting portion 17*c* of the regulator 11 by the fuel outlet inner circumferential wall 11*u*. Thus, when the regulator outlet side fuel pipe 16*c* is removed, the fourth fuel filter 19 is held without coming off and also can easily be removed.

The third and fourth fuel filters 18, 19 are installed; therefore, an effect of removing foreign matter mixed in the fuel can be increased. In particular, if fuel full of an alcohol components is used, the filtering effect is improved. In addition, the third and fourth fuel filters 18 and 19 are installed in both the connecting portions 17*b* and 17*c*, respectively, of the regulator 11. Therefore, also maintenance performance is satisfactory.

In the present invention, the third fuel filter 18 and the fourth fuel filter 19 in the first and second embodiments are each formed in a generally cylindrical shape. However, the shape is not necessarily limited to this but can be changed variously. Also the magnitude (length) of the third and fourth fuel filters 18, 19 may be greater than that in the embodiments described above, so long as their length is permissible in the inlet side connection pipe portion 11*b* and the outlet side connection pipe portion 11*c*. Further, the third and fourth fuel filters may be made to have a wavy shape to increase its surface area, i.e., its filtering area, thereby making it possible to extend a life of filtration.

In the present invention, the sizes of the meshes of the third and fourth fuel filters 18, 19 may be the same as or different from that of the secondary fuel filter 13 and also may be set at an appropriate size depending on its objective. The embodiments described above are configured such that the fuel pump is installed in the fuel tank. However, the present invention is not limited to this configuration.

The embodiments shown before explains the motorcycle. However, the fuel supply structure for the saddle-ride type vehicle relating to the present invention can be applied to various internal combustion engines as well as three-wheeled, four-wheeled and other saddle-ride type vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle fuel supply structure wherein fuel in a fuel tank is supplied under pressure by a fuel pump to a fuel injection valve via a secondary fuel filter adapted to filter the fuel to remove foreign matter and a regulator adapted to regulate fuel pressure, comprising:

said secondary fuel filter, the regulator and the fuel injection valve being connected by fuel pipes;

a third fuel filter is installed at least in an inlet side connecting portion between the regulator and a regulator inlet side fuel pipe of the fuel pipes, the regulator inlet side fuel pipe being adapted to deliver fuel to the regulator, said third fuel filter including a cylindrical frame member having a flange portion formed in a generally donut-shape, said flange portion being positionally restricted by a stepped inner surface of the male connector portion facing the flange portion;

a fourth fuel filter is installed in an outlet side connecting portion between the regulator and a regulator outlet side fuel pipe adapted to deliver fuel from the regulator to the fuel injection valve;

an outlet side fuel pipe operatively connected to the regulator for supplying fuel to the fuel injector valve;

a return side fuel pipe operatively connected to the regulator for returning surplus fuel to the fuel tank; and said regulator including a regulator body having an inlet side connection pipe, an outlet side connection pipe and a return side connection pipe with an inlet side quick connector installed to connect the regulator inlet side connection pipe with the regulator inlet side fuel pipe and an outlet side quick connection installed to connect the regulator outlet side connection pipe with the regulator outlet side fuel pipe, said regulator inlet side connection pipe extending substantially vertically upwardly from the secondary fuel filter wherein said regulator is positioned above the secondary fuel filter so that when the secondary fuel filter is re s laced bubbles mixed into the regulator inlet side fuel pipe can rapidly be led through an ascending force to the third fuel filter disposed on an upside of the second fuel filter.

2. The vehicle fuel supply structure according to claim 1, wherein the third fuel filter is positioned and held in the inlet side connecting portion by a fuel inlet inner circumferential wall of the regulator.

3. The vehicle fuel supply structure according to claim 1, wherein the fourth fuel filter is positioned and held in the outlet side connecting portion by a fuel outlet inner circumferential wall of the regulator.

4. The vehicle fuel supply structure according to claim 1, wherein the fuel pump is installed in the fuel tank;

a tank bottom portion provided with a fuel discharge port of the fuel pump is formed with a tank hanging wall hanging downward of the vehicle;

the regulator is mounted on the inside of the tank hanging wall; and the secondary fuel filter is installed below the tank bottom portion.

5. The vehicle fuel supply structure according to claim 4, wherein the regulator is disposed above the secondary fuel filter.

6. A vehicle fuel supply structure comprising:

a fuel tank;

a fuel injection valve;

a fuel pump for pressurizing fuel supplied to the fuel injection valve;

a secondary fuel filter adapted to filter fuel to remove foreign matter; and a regulator operatively connected to the fuel pump for regulating fuel pressure of the fuel supplied to the fuel injection valve;

said secondary fuel filter, the regulator and the fuel injection valve being operatively connected by fuel pipes;

a third fuel filter installed at least in an inlet side connecting portion between the regulator and a regulator inlet side fuel pipe of the fuel pipes, the regulator inlet side fuel pipe being adapted to deliver fuel to the regulator, said third fuel filter including a cylindrical frame member having a flange portion formed in a generally donut-shape, said flange portion being positionally restricted by a stepped inner surface of a male connector portion facing the flange portion;

a fourth fuel filter is installed in an outlet side connecting portion between the regulator and a regulator outlet side fuel pipe adapted to deliver fuel from the regulator to the fuel injection valve;

an outlet side fuel pipe operatively connected to the regulator for supplying fuel to the fuel injector valve;

a return side fuel pipe operatively connected to the regulator for returning surplus fuel to the fuel tank; and said regulator including a regulator body having an inlet side connection pipe, an outlet side connection pipe and a return side connection pipe with an inlet side quick connector installed to connect the regulator inlet side connection pipe with the regulator inlet side fuel pipe and an outlet side quick connection installed to connect the regulator outlet side connection pipe with the regulator outlet side fuel pipe, said regulator inlet side connection pipe extending substantially vertically upwardly from the secondary fuel filter wherein said regulator is positioned above the secondary fuel filter so that when the secondary fuel filter is replaced, bubbles mixed into the regulator inlet side fuel pipe can rapidly be led through an ascending force to the third fuel filter disposed on an upside of the second fuel filter.

7. The vehicle fuel supply structure according to claim 6, wherein the third fuel filter is positioned and held in the inlet side connecting portion by a fuel inlet inner circumferential wall of the regulator.

8. The vehicle fuel supply structure according to claim 7, wherein the fourth fuel filter is positioned and held in the outlet side connecting portion by a fuel outlet inner circumferential wall of the regulator.

9. The vehicle fuel supply structure according to claim 6, wherein the fuel pump is installed in the fuel tank;

a tank bottom portion provided with a fuel discharge port of the fuel pump is formed with a tank hanging wall hanging downward of the vehicle;

the regulator is mounted on the inside of the tank hanging wall; and the secondary fuel filter is installed below the tank bottom portion.

10. The vehicle fuel supply structure according to claim 9, wherein the regulator is disposed above the secondary fuel filter.

* * * * *